US006726501B2

(12) United States Patent
Waddell et al.

(10) Patent No.: US 6,726,501 B2
(45) Date of Patent: Apr. 27, 2004

(54) LATCHING SYSTEM FOR ELECTRICAL CONNECTORS

(75) Inventors: Kent D. Waddell, Ennis (IE); Peter Curtin, Ennis (IE); Eugene Folan, Galway (IE); John M. Horgan, Limerick (IE); Enda Kelly, Kilshanny (IE); Joseph McCarthy, Cappamore (IE); Michael Magajne, Heilbron-Biberach (IE); Brian Murphy, Mungret (IE); John Wallace, Racefield (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/177,490

(22) Filed: Jun. 21, 2002

(65) Prior Publication Data

US 2003/0236017 A1 Dec. 25, 2003

(51) Int. Cl.[7] ..... H01R 13/627
(52) U.S. Cl. ..... 439/352; 439/358
(58) Field of Search ..... 439/352, 358, 439/357, 350, 351, 353–356

(56) References Cited

U.S. PATENT DOCUMENTS

| | | | | |
|---|---|---|---|---|
| 4,678,256 | A | 7/1987 | Nishino et al. | 439/347 |
| 4,699,438 | A | 10/1987 | Kikuta | 439/95 |
| 4,702,542 | A | 10/1987 | Noyes | 439/347 |
| 4,778,411 | A | 10/1988 | Rudy, Jr. et al. | 439/681 |
| 4,838,810 | A | 6/1989 | Yoshimura et al. | 439/358 |
| 4,842,542 | A | 6/1989 | Davis | 439/357 |
| 4,961,711 | A | 10/1990 | Fujiura et al. | 439/357 |
| 5,011,424 | A | 4/1991 | Simmons | 439/352 |
| 5,011,425 | A | 4/1991 | Van Zanten et al. | 439/353 |
| 5,104,334 | A | 4/1992 | Honma et al. | 439/357 |
| 5,154,629 | A | 10/1992 | Carver et al. | 439/352 |
| 5,178,556 | A | 1/1993 | Chen | 439/357 |
| 5,197,901 | A | 3/1993 | Hashiguchi | 439/352 |
| 5,201,669 | A | 4/1993 | Lin | 439/357 |
| 5,334,041 | A | 8/1994 | Anbo et al. | 439/358 |
| 5,383,794 | A | 1/1995 | Davis et al. | 439/352 |
| 5,454,726 | A | 10/1995 | Lee et al. | 439/65 |
| 5,588,864 | A | 12/1996 | Lin | 439/357 |
| 5,611,708 | A | 3/1997 | Mizunuma et al. | 439/358 |
| 5,702,266 | A | 12/1997 | Jones | |
| 5,713,752 | A | 2/1998 | Leong et al. | 439/358 |
| 5,716,228 | A | 2/1998 | Chen | 439/358 |
| 5,741,150 | A | 4/1998 | Stinson et al. | 439/358 |
| 5,762,514 | A | 6/1998 | Long et al. | 439/358 |
| 5,775,931 | A | 7/1998 | Jones | 439/358 |
| 5,860,826 | A | 1/1999 | Chang | 439/358 |
| 5,941,726 | A | 8/1999 | Koegel et al. | 439/358 |
| 5,971,790 | A | 10/1999 | Rohde | 439/357 |
| 6,056,578 | A | 5/2000 | Lin | 439/358 |
| 6,123,575 | A * | 9/2000 | Huang et al. | 439/352 |
| 6,149,451 | A | 11/2000 | Weber | 439/358 |
| 6,217,364 | B1 | 4/2001 | Miskin et al. | 439/358 |
| 6,234,828 | B1 | 5/2001 | Kuo | 439/358 |
| 6,485,315 | B1 * | 11/2002 | Hwang | 439/358 |
| 2001/0020538 | A1 | 9/2001 | Kinezuka | |

FOREIGN PATENT DOCUMENTS

| | | |
|---|---|---|
| DE | 55/2622 | 4/1956 |
| GB | 2 254 199 A | 9/1992 |

* cited by examiner

*Primary Examiner*—Gary Paumen
(74) *Attorney, Agent, or Firm*—Stephen Z. Weiss

(57) ABSTRACT

A latching system is provided for an electrical connector which includes a connector housing mounting a plurality of conductive terminals in a terminal module for contacting the terminals of an appropriate mating connecting device. At least one elongated latch arm has a front latching end and a rear end. The latch arm has an enlarged integral pivot portion intermediate its opposite ends. The housing includes an elongated groove for receiving the elongated latch arm. The groove has an enlarged journal portion for receiving the pivot portion of the latch arm. The groove has an enlarged cavity portion at one side thereof. A spring independent of the latch arm is located in the enlarged cavity portion of the groove for pivoting the latch arm in a latching direction.

17 Claims, 3 Drawing Sheets

LATCHING SYSTEM FOR ELECTRICAL CONNECTORS

FIELD OF THE INVENTION

This invention generally relates to the art of electrical connectors and, particularly, to a latching system for such connectors.

BACKGROUND OF THE INVENTION

Generally, an electrical connector typically includes some form of housing which mounts a plurality of conductive terminals for connection to the terminals of a complementary mating connecting device such as a second connector. When the connector is mated with the mating device or second connector, some form of latching means often is provided to prevent the connectors from becoming unintentionally unmated.

Heretofore, many latching devices, arms or the like have been formed integrally with the connector housing. However, such integral latch arms cause problems in that they often do not provide sufficient latching forces and they are prone to damage or breakage. Latch arms which are independent of the connector housing have been used but, when a pair of latch arms are used, they are difficult to unlatch simultaneously. Also, spring members, which are integrally formed with the latch arm, do not always provide consistently predictable forces without the use of tight manufacturing control. Inconsistent forces can cause differential latching side loads which can result in one side of the connector assembly becoming decoupled and causing signal loss and potential damage to the latched components. In addition, the latch arms with separate spring members are not easily manufactured due to, for example, means for attaching the spring member to the latch arm. The present invention is directed to solving these problems by providing an improved latch arm arrangement in an electrical connector assembly.

SUMMARY OF THE INVENTION

An object, therefore, of the invention is to provide a new and improved latching system for an electrical connector.

In the exemplary embodiment of the invention, a connector housing has a front mating end and a rear terminating end. The housing mounts a plurality of conductive terminals for contacting the terminals of an appropriate mating connecting device. At least one elongated latch arm has a front latching end and a rear actuating/unlatching end. The latch arm has an enlarged integral pivot portion intermediate its front and rear ends. The housing includes an elongated groove extending between its front mating end and rear terminating end. The groove receives the elongated latch arm, with the front latching end of the arm near the front mating end of the housing and the rear actuating/unlatching end of the arm exposed at the rear terminating end of the housing. The groove has an enlarged journal portion for receiving the enlarged pivot portion of the latch arm. The groove also has an enlarged cavity portion at one side thereof. A spring is provided independent of the latch arm for pivoting the latch arm about the pivot portion thereof and biasing the front latching end of the latch arm in a latching direction. The spring is located in the enlarged cavity portion of the elongated groove in the connector housing.

As disclosed herein, a pair of the elongated latch arms are provided and are positioned in a corresponding pair of the elongated grooves at opposite sides of the connector housing. Preferably, the elongated latch arms are fabricated of metal material. An insulating covering is provided over the rear actuating/unlatching end of each latch arm. The spring also is preferably fabricated of metal material.

According to one aspect of the invention, the spring for each latch arm and the enlarged cavity portion for each respective groove are located rearwardly of the pivot portion of the respective latch arm and the journal portion of the groove. The springs are located inside the latch arms behind the pivot portions of the arms to bias the front latching ends of the arms in inwardly latching directions.

According to another aspect of the invention, each spring is formed as a leaf spring which has opposite ends folded back over an intermediate portion thereof. The opposite ends are adjacent each other and spaced from the intermediate portion.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
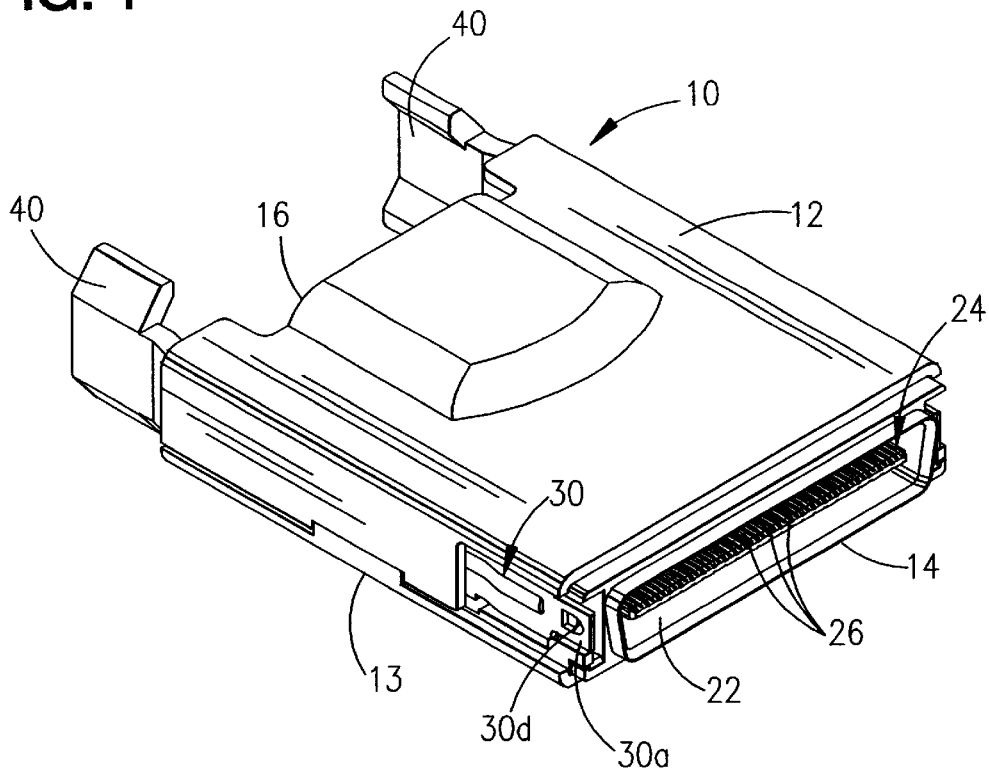
FIG. 1 is a perspective view looking toward the front mating end of an electrical connector embodying the latching system of the invention.
Figure 2:
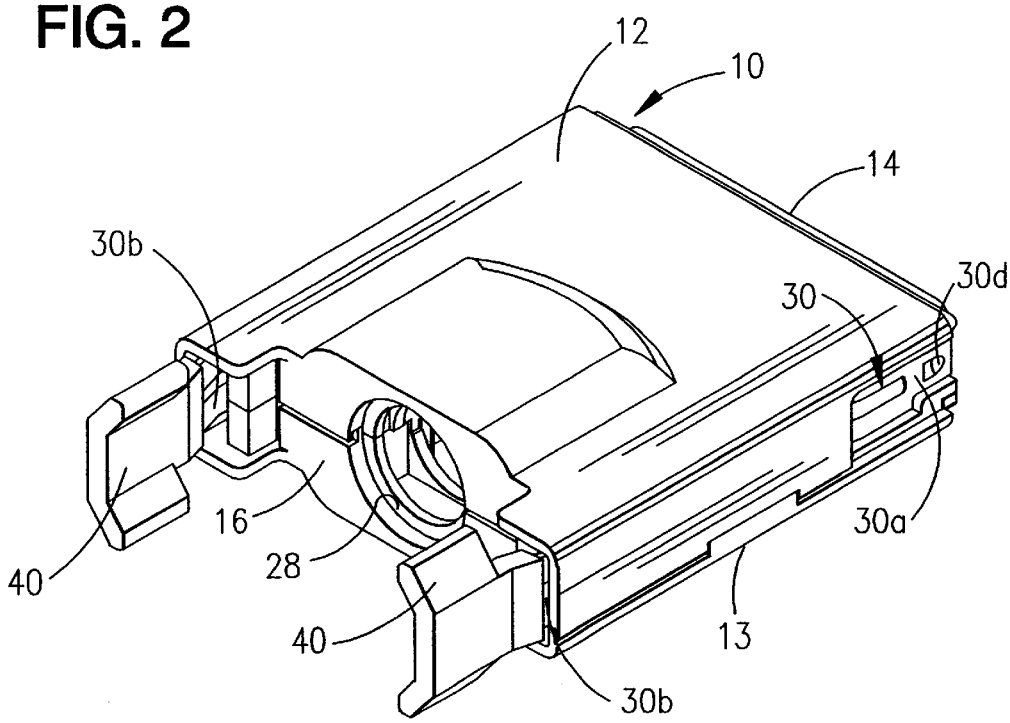
FIG. 2 is a perspective view looking at the rear terminating end of the electrical connector.

Referring to the drawings in greater detail, and first to FIGS. 1 and 2, the latching system of the invention is embodied in an electrical connector, generally designated 10, which includes an insulating upper cover 12, an insulating lower cover 13 and a two-part conductive housing. The housing which is surrounded by the two-part cover includes a cover housing part, generally designated 18, and a base housing part, generally designated 20. The housing defines a front mating end 14 and a rear terminating end 16 of the connector.

As best seen in FIG. 1, front mating end 14 of connector housing 18, 20 defines a plug 22 for receiving a receptacle portion of an appropriate or complementary mating connecting device or second connector. Between the cover housing part 18 and the base housing part 20 is mounted a terminal module, generally designated 24 (only appearing in FIG. 1), which carries in a non conductive material a plurality of conductive terminals 26 for contacting the terminals of the mating connector.

As best seen in FIG. 2, rear terminating end 16 of connector housing 18, 20 includes a cable-receiving aperture 28 through which a multi-wire electrical cable (not shown) is located. The individual or discrete wires or conductors of the electrical cable are electrically connected to terminals 26 of the connector. Actually, as can be seen in FIG. 3, one-half of cable-receiving aperture 28 is located in each of the cover housing part 18 and the base housing part 20 of the connector.

Figure 3:
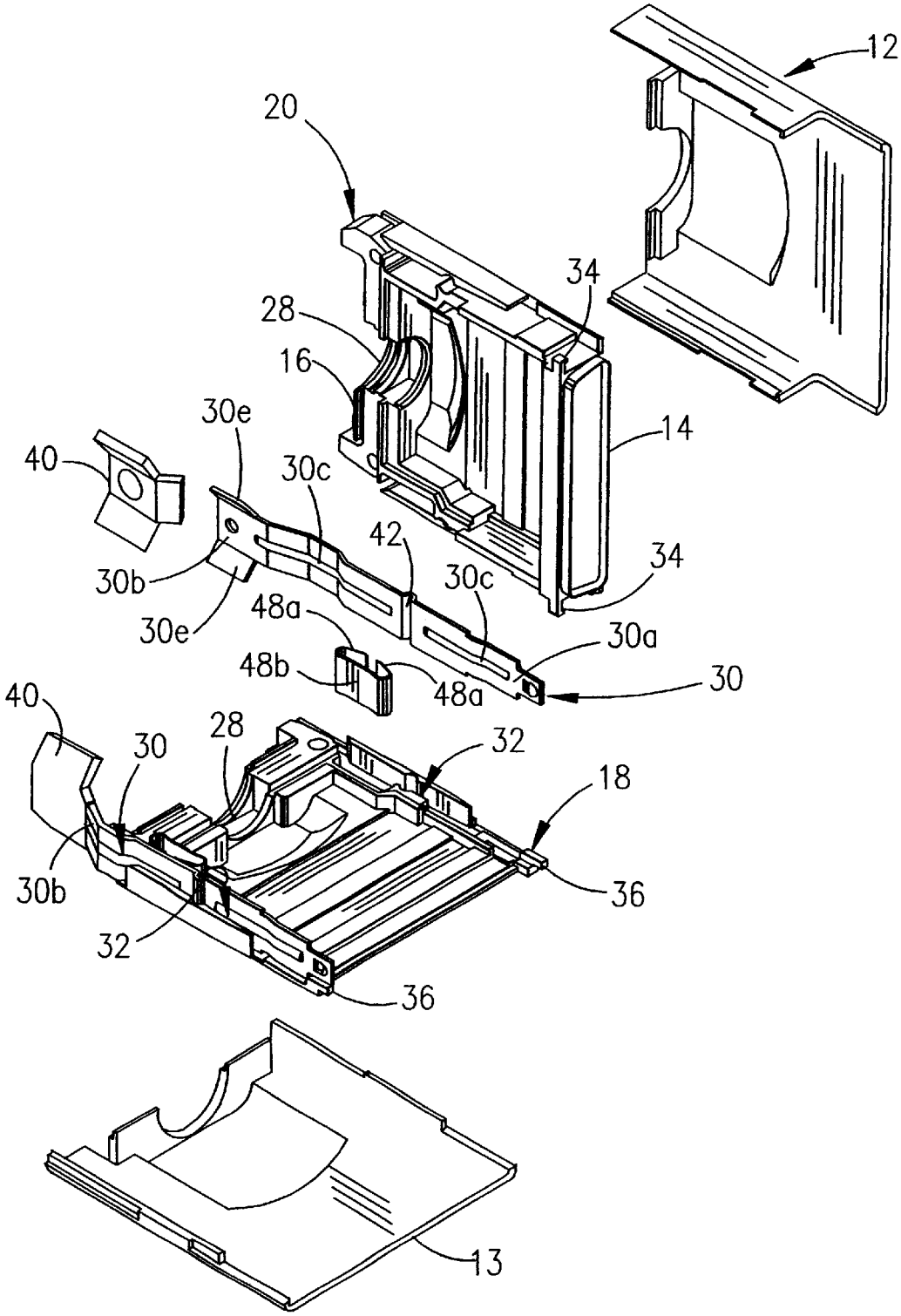
FIG. 3 is an exploded perspective view of the electrical connector, with the interior terminal module removed.

Referring to FIG. 3 in conjunction with FIGS. 1 and 2, the invention herein centers around a pair of elongated latch arms, generally designated 30, which are positioned within grooves, generally designated 32, in cover housing part 18 and base housing part 20. In essence, latch arms 30, while positioned within grooves 32, are sandwiched between the two housing parts. The interior terminal module 24 has been removed from FIG. 3 (as well as FIGS. 4 and 5) to facilitate the illustration. FIG. 3 shows one of the latch arms 30 positioned within one of the grooves 32 of cover housing part 18. As can be seen, approximately one-half of the latch arm along its length is positioned within the groove of the cover housing part. When base housing part 20 is positioned over the base housing part 18, the latch arms equally project into grooves 32 of both the base housing part 20 and the cover housing part 18. FIG. 3 also shows that base housing part 20 has a plurality of side latching flanges 34 which snap over a plurality of latching ribs 36 on the outer sides of cover housing part 18 to hold the two housing parts together sandwiching the latch arms therebetween as well as mounting terminal module 24 within the two-part housing.

Figure 4:
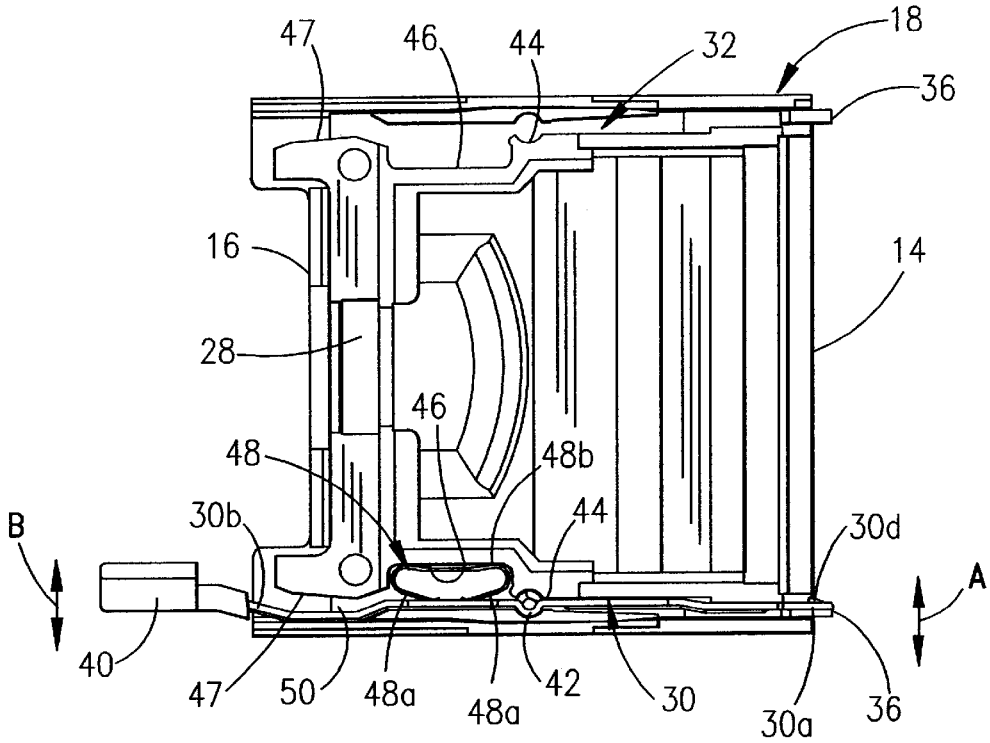
FIG. 4 is a top plan view looking at the base housing part, with one of the latch arms and independent springs mounted therewithin.

Referring to FIG. 4 in conjunction with FIG. 3, each latch arm 30 is an elongated member stamped and formed of metal material to define a front latching end 30*a* and a rear actuating/unlatching end 30*b*. Stiffening ribs 30*c* are formed in the latch arms lengthwise thereof. Front latching end 30*a* has an inside latching boss 30*d* for engaging a latching component of the complementary mating connector. Rear actuating/unlatching end 30*b* of each latch arm includes a pair of inwardly angled wing portions 30*e*. An insulating covering 40 is positioned over the rear actuating/unlatching end 30*b* of each latch arm. Finally, each latch arm is stamped and formed with an integral pivot portion 42 which is intermediate its front latching end 30*a* and its rear actuating/unlatching end 30*b*.

Still referring to FIG. 4 in conjunction with FIG. 3, each groove 32 at each opposite side of each of base housing part 18 and cover housing part 20 is substantially identical and includes a number of portions or sections. First of all, each groove 32 is elongated and extends along each side of each housing part generally between front mating end 14 and rear terminating end 16 of the connector. The elongated grooves are configured for receiving elongated latch arms 30 with the front latching ends 30*a* of the latch arms exposed at front mating end 14 of the connector as clearly seen in FIG. 4. FIG. 4 shows how the rear actuating/unlatching ends of the latch arms, surrounded by insulating coverings 40, are exposed or project rearwardly beyond rear terminating end 16 of the connector.

FIG. 4 best shows that each groove 32 has an enlarged journal portion 44 which is the location of the pivot for receiving pivot portion 42 of the respective latch arm. Therefore, front latching end 30*a* and rear actuating/unlatching end 30*b* of each latch arm 30 can move about pivot portion 42 back and forth in the direction of double-headed arrow "A" for the front end and double-headed arrow "B" for the rear end. With the pivot being between the opposite ends, when the rear end moves inwardly, the front end moves outwardly and vice versa. Each groove 32 also includes an enlarged cavity portion 46 at the inside of the groove rearwardly of journal portion 44. The cavity portion receives a spring, generally designated 48, which will be described in greater detail hereinafter. With the spring located rearwardly of the pivot or enlarged journal portion 44 of the pivot and inside the latch arm, the spring is effective to bias the rear end of the latch arm outwardly and bias the front end of the latch arm inwardly in a latching direction.

Each groove 32 includes an anti-overtravel abutment surface 47 at the inside thereof near the rear of the groove. As can be seen clearly in FIG. 4, anti-overtravel abutment surface 47 is spaced, as at 50, from rear end 30*b* of the latch arm when the latch-arm is in its spring-biased latching position as shown.

Each spring 48 is formed as a metal leaf spring which has opposite ends 48*a* folded back over an intermediate portion 48*b* of the spring. Therefore, opposite ends 48*a* of the spring are adjacent each other and, as shown, are spaced from intermediate portion 48*b*. With this unique construction of the leaf spring, folded back opposite ends 48*a* provide two spring arms and can thereby double the spring forces from a single spring component. By providing the spring independent of its respective latch arm 30, different materials can be used for the springs from the latch arms to provide different forces and/or spring characteristics as design parameters dictate. This simple spring construction designed to easily slip into enlarged cavity portions 46 adds to the ease of manufacture.

Figure 5:
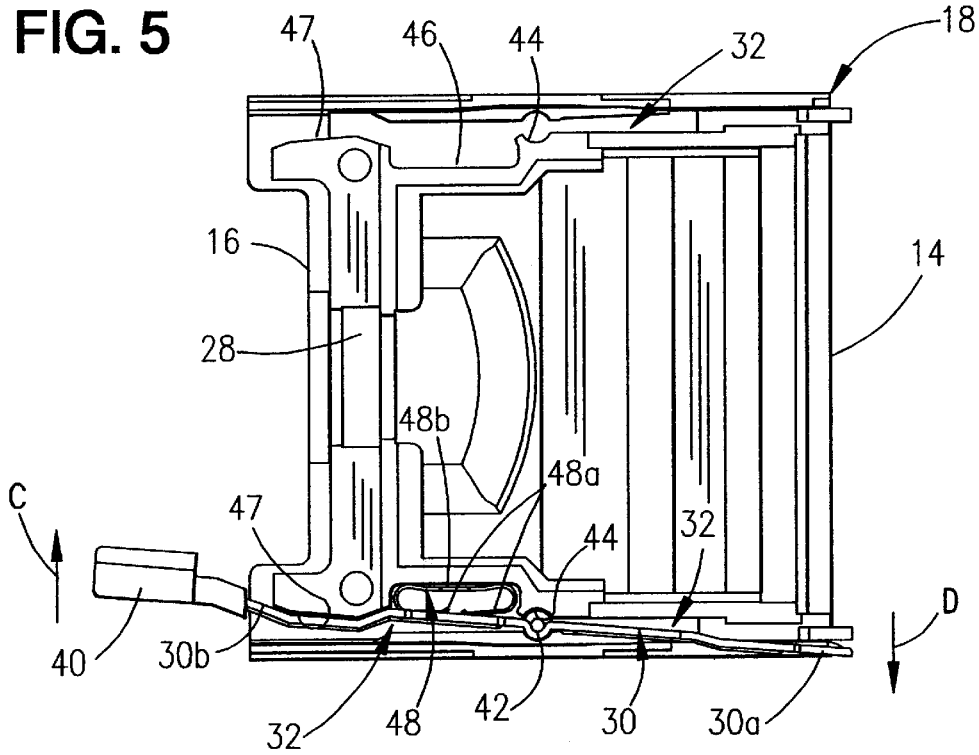
FIG. 5 is a view similar to that of FIG. 4, with the latch arm pivoted to an unlatching position.

In comparing FIG. 5 with FIG. 4, it can be seen that actuating/unlatching end 30*b* of latch arm 30 has been moved inwardly in the direction of arrow "C". This pivots the spring arm about enlarged pivot portion 42 and moves front latching end 30*a* of the spring arm outwardly in the direction of arrow "D" so that the connector can be unlatched from its complementary mating connecting device or second connector. FIG. 5 also shows that the rear end of the latch arm has come into abutment with anti-overtravel abutment surface 47 at the inside of groove 32 at the rear of the groove. This anti-overtravel surface prevents the latch arm from being excessively biased inwardly which could cause damage or deformation to the latch arm and/or spring 48.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A latching system for an electrical connector, comprising:

a connector housing having a front mating end and a rear terminating end and mounting a plurality of conductive terminals in a terminal module for contacting the terminals of an appropriate mating connecting device;

at least one elongated latch arm having a front latching end and a rear actuating/unlatching end, the latch arm having an integral pivot portion intermediate its front and rear ends;

said housing including an elongated groove extending between its front mating end and rear terminating end, the groove receiving the elongated latch arm with the front latching end thereof near the front mating end of the housing and the rear actuating/unlatching end thereof exposed at the rear terminating end of the housing, the groove having an enlarged journal portion for receiving the pivot portion of the latch arm, and the groove having an enlarged cavity portion at one side thereof; and a spring independent of the latch arm for pivoting the latch arm about the pivot portion thereof and biasing the front latching end of the latch arm in a latching direction, the spring being located in said enlarged cavity portion of the elongated groove in the connector housing.

2. The latching system of claim 1, including a pair of said elongated latch arms in a corresponding pair of said elongated grooves at opposite sides of the connector housing.

3. The latching system of claim 1 wherein said elongated latch arm is fabricated of metal material.

4. The latching system of claim 3, including an insulating covering over the rear actuating/unlatching end of the latch arm.

5. The latching system of claim 1 wherein said spring and the enlarged cavity portion of said groove are located rearwardly of the pivot portion of the latch arm and the journal portion of the groove.

6. The latching system of claim 5 wherein said latch arm and groove are located at one side of the connector housing, and the spring is located inside the latch arm to bias the front latching end thereof in an inward latching direction.

7. The latching system of claim 1 wherein said spring comprises a leaf spring which has opposite ends folded back over an intermediate portion with the opposite ends being adjacent each other and spaced from said intermediate portion.

8. The latching system of claim 7 wherein said spring is fabricated of metal material.

9. A latching system for an electrical connector, comprising:

a connector housing having a front mating end and a rear terminating end and mounting a plurality of conductive terminals for contacting the terminals of an appropriate mating connecting device;

a pair of elongated latch arms fabricated of metal material and each latch arm having a front latching end and a rear actuating/unlatching end, each latch arm having an integral pivot portion intermediate its front and rear ends;

said housing including a pair of elongated grooves at opposite sides of the housing extending between its front mating end and rear terminating end, each groove receiving one of the elongated latch arms with the front latching end thereof near the front mating end of the housing and the rear actuating/unlatching end thereof exposed at the rear terminating end of the housing, each groove having an enlarged journal portion for receiving the pivot portion of a respective one of the latch arms, and each groove having an enlarged cavity portion at one side thereof, and a spring independent of each latch arm for pivoting the respective latch arm about the pivot portion thereof and biasing the front latching end of the respective latch arm in a latching direction, the springs being located in said enlarged cavity portions of the elongated grooves in the connector housing.

10. The latching system of claim 9, including an insulating covering over the rear actuating/unlatching end of each of the latch arms.

11. The latching system of claim 9 wherein each spring and the enlarged cavity portion of the respective groove are located rearwardly of the pivot portion of the respective latch arm and the journal portion of the groove.

12. The latching system of claim 11 wherein said springs are located inside the latch arms to bias the front latching ends of the latch, arms in inwardly latching directions.

13. The latching system of claim 9 wherein each spring comprises a leaf spring which has opposite ends folded back over an intermediate portion with the opposite ends being adjacent each other and spaced from said intermediate portion.

14. A latching system for an electrical connector, comprising:

a connector housing mounting a plurality of conductive terminals in a terminal module for contacting the terminals of an appropriate mating connecting device;

at least one elongated latch arm movably mounted in an elongated groove on the housing and having a front latching end and a rear end; and a spring independent of the latch arm for biasing the front latching end thereof in a latching direction, the spring being a leaf spring which has opposite ends folded back over an intermediate portion with the opposite ends being adjacent each other and spaced from the intermediate portion, the spring mounted in an enlarged cavity portion in the housing communicating with the enlarged groove.

15. The latching system of claim 14 wherein said spring is fabricated of metal material.

16. The latching system of claim 15 wherein said elongated latch arm is fabricated of metal material.

17. The latching system of claim 14, including a pair of said elongated latch arms at opposite sides of the connector housing, with a corresponding pair of said springs operatively associated with the latch arms.

* * * * *